US009357889B2

(12) United States Patent
McFarlane

(10) Patent No.: US 9,357,889 B2
(45) Date of Patent: Jun. 7, 2016

(54) TOILET SEAT CLOSURE MECHANISM

(76) Inventor: Magnus M. McFarlane, Birmingham (GB)

( * ) Notice: Subject to any disclaimer, the term of this patent is extended or adjusted under 35 U.S.C. 154(b) by 182 days.

(21) Appl. No.: 14/128,175

(22) PCT Filed: Jun. 22, 2012

(86) PCT No.: PCT/GB2012/051452
§ 371 (c)(1),
(2), (4) Date: Dec. 20, 2013

(87) PCT Pub. No.: WO2012/175980
PCT Pub. Date: Dec. 27, 2012

(65) Prior Publication Data

US 2014/0130245 A1 May 15, 2014

(30) Foreign Application Priority Data

Jun. 23, 2011 (GB) ..... 1110656.4

(51) Int. Cl.
*A47K 13/10* (2006.01)
*E03D 5/04* (2006.01)

(52) U.S. Cl.
CPC .. *A47K 13/10* (2013.01); *E03D 5/04* (2013.01)

(58) Field of Classification Search
CPC ..... A47K 13/10; A47K 13/12; A47K 13/245; A47K 13/26; A47K 13/00; E03D 5/04; E03D 2201/00
USPC ..... 4/246.2, 246.1, 241, 249
See application file for complete search history.

(56) References Cited

U.S. PATENT DOCUMENTS 1,907,826 A * 5/1933 Kapp ..... A47K 13/10 4/249
5,222,260 A * 6/1993 Piper ..... A47K 13/10 16/303
5,369,814 A 12/1994 Denys
5,400,442 A * 3/1995 Pendlebury ..... A47K 13/10 4/236
5,414,876 A * 5/1995 Pan ..... E03D 5/04 4/241
5,430,897 A * 7/1995 Lavender ..... A47K 13/10 4/246.1
5,781,938 A * 7/1998 Anderson ..... A47K 13/10 4/241
5,794,277 A * 8/1998 Jones ..... A47K 13/12 4/236
6,510,562 B1 * 1/2003 Bae ..... A47K 13/10 4/241
8,006,323 B1 * 8/2011 Potter ..... A47K 13/10 4/241
2007/0044215 A1 * 3/2007 Chiu ..... A47K 13/10 4/246.1
2008/0178374 A1 * 7/2008 Abrams ..... A47K 13/10 4/246.2
2011/0145985 A1 * 6/2011 Lin ..... A47K 13/10 4/246.1
2012/0192341 A1 * 8/2012 Trout ..... A47K 13/10 4/246.1

FOREIGN PATENT DOCUMENTS

| | | |
|---|---|---|
| CA | 2143557 | 8/1996 |
| GB | 256619 | 7/1927 |
| GB | 570974 | 10/1941 |
| GB | 2050462 A | 1/1981 |
| WO | WO 2008/092144 | 7/2008 |

OTHER PUBLICATIONS

International Search Report, PCT/GB2012/051452, mailed Oct. 14, 2013.
Written Opinion of the International Searching Authority, PCT/GB2012/051452, mailed Oct. 14, 2013.
Search Report of the United Kingdom Intellectual Property Office (UKIPO), GB1110656.4, dated Oct. 30, 2011.

* cited by examiner

*Primary Examiner* — J. Casimer Jacyna
*Assistant Examiner* — Benjamin R Shaw
(74) *Attorney, Agent, or Firm* — Reichel Stohry LLP; Mark C. Reichel; Natalie J. Dean

(57) ABSTRACT

A toilet seat and/or lid assembly comprising a toilet seat and/or lid and a device (100) for automatically lowering a toilet seat and/or lid, the device (100) comprising activation means including an activation member (170), the activation member (170) depending from the toilet seat and/or lid so as to be positioned, in use, in a toilet basin below the upper surface thereof, the activation member (170) being arranged to be moved by flow of water in the toilet basin from flushing the toilet to activate the activation means to operate closure means to close the toilet seat and/or lid.

23 Claims, 7 Drawing Sheets

TOILET SEAT CLOSURE MECHANISM

PRIORITY

The present application is related to, and claims the priority benefit of, International Patent Application Serial No. PCT/GB2012/051452, filed Jun. 22, 2012, which is related to, and claims the priority benefit of, Great Britain Patent Application Serial No. 1110656.4, filed Jun. 23, 2011. The contents of each of these applications are hereby incorporated by reference in their entirety into this disclosure.

TECHNICAL FIELD

This invention relates to a device and method for enabling the automatic closure of a toilet seat and/or lid after the toilet has been used.

BACKGROUND TO THE INVENTION

Conventional western style toilets comprise a bowl or basin, a substantially planar seat having a wide aperture (the width of which is often comparable to the width of the basin) arranged to be supported by the rim of the bowl or basin, and a solid, substantially planar lid which covers the seat and basin. The seat and lid are usually hingedly attached to the basin or toilet such that they may be moved (independently or together) between substantially horizontal and substantially vertical positions.

When the toilet is in use, the lid (and in some cases also the seat) is in a substantially vertical position and often rests against a wall or side of the water tank. When the toilet is not being used, it is desirable for the lid to be in a substantially horizontal position (such that it covers the basin) for aesthetic and hygiene related reasons. However, closure of the lid after the toilet has been used is often neglected or forgotten entirely.

A number of devices have been developed in recent years which are designed to enable automatic closure of a toilet lid. Some of these devices are permanently fitted to the toilet and may be fitted to the toilet assembly during manufacture or require permanent alteration of the toilet assembly to accommodate their use. These devices may be made specifically for a particular type or configuration of toilet assembly, and as such their use is limited to a particular type of toilet. In addition, some existing devices require power to operate. Consequently, such devices are often expensive to manufacture and require specialist expertise for fitting and may therefore be expensive to fit. Such devices may also be obtrusive and present a hygiene issues due to their permanence.

In addition, it is now desirable, for economical and environmental reasons, to limit, or at least effectively monitor (in order to help reduce), water and power usage.

It is therefore an aim of the present inventions to eliminate or at least mitigate some of the drawbacks of existing toilet lid closure devices.

SUMMARY OF THE INVENTION

Accordingly, a first aspect of the invention provide a closure device according to appended claim 1.

According to a second aspect of the invention, there is provided a method of automatically closing a toilet seat and/or lid according to appended claim 14.

Preferable features of the invention are provided according to the appended dependent claims.

BRIEF DESCRIPTION OF THE DRAWINGS

An example of a toilet seat closure mechanism in accordance with the present invention will be described with reference to the following figures in which.

DETAILED DESCRIPTION

For the majority of toilets, the basin and cistern are permanently fitted in place. A lid and seat are usually hingedly attached to the basin (often by two hinges), so that they can pivot about a horizontal axis to allow for opening and closing of the seat (which lies directly over the basin) and the lid (which lies on top of the seat to cover the basin).

Due to breakage or wear, for example, the toilet lid and seat may be replaced more often than the basin and tank. As such, toilet lids and seats are manufactured as replaceable parts of a toilet and may be retrofitted to the toilet basin. Accordingly, a variety of lids and seat assemblies may be fitted to a basin by releasing the hinge mechanism, replacing the seat and lid (or the seat or lid), and re-fitting the hinge accordingly.

The closure device of the present invention is permanently fixed to a lid and seat assembly during manufacture, such that the device is integral to the seat and lid assembly (where the lid and seat are sold together) or to the lid (where the lid is sold without the seat and is retrofitted to a basin and existing seat). The device of the present invention may be fixed to any number of differing shapes and sizes of lid or lid and seats by adjusting the dimension of the device and/or attaching the device during manufacture in an appropriate position.

Figure 1:
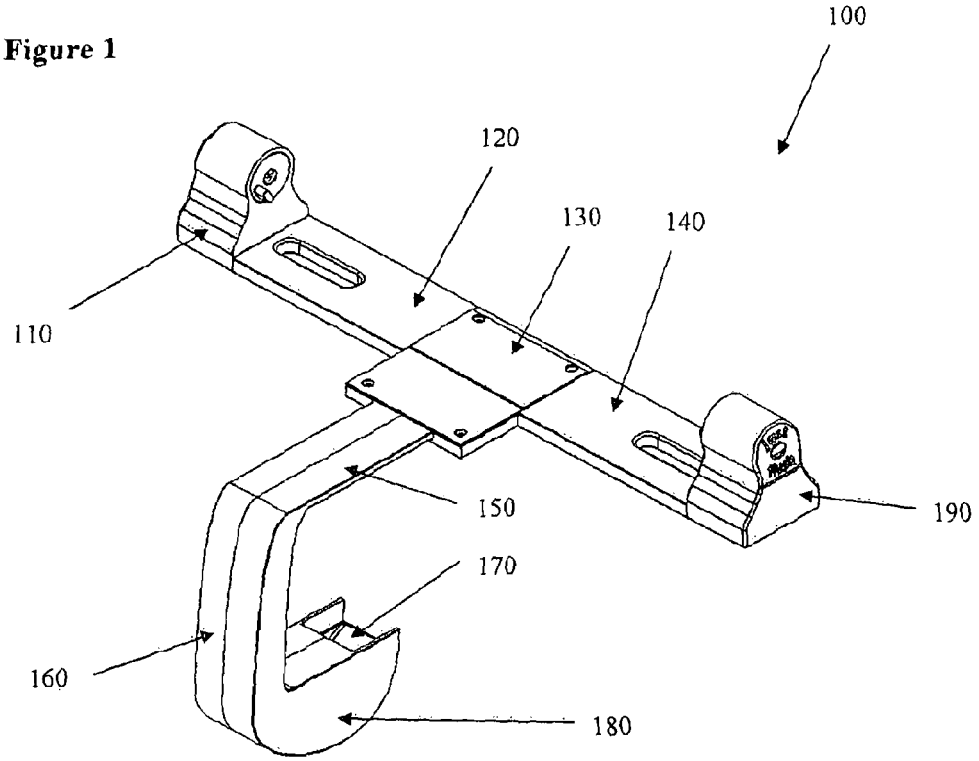
FIG. 1 is a perspective view of a closure device (unattached to a toilet lid or lid and seat assembly) according to an embodiment.

FIG. 1 shows an exemplary closure device 100 which is may be secured to a toilet lid or lid and seat (not shown). Device 100 comprises central portion 130 and arm 150 which extends laterally from central portion 130. Arm 150 comprises hooked portion 160, hooked portion 160 lying in a plane which is orthogonal to a plane defined by central portion 130. Portion 180 is located at the distal end of hooked portion 160. Portion 180 comprises parallel walls 160 which encloses paddle 170, such that paddle 170 is located between the walls 160. The curved nature of hooked portion 160 is such that, when central portion 130 lies in a horizontal plane, paddle 170 lies directly below arm 150. Extending from central portion 130 are identical arms 120, 140. Housing members 110, 190 are fixed to the distal ends of arms 120, 140 respectively. Housing member 110, 190 house components which effect the closure mechanism, as will be described in more detail below.

When affixed to a toilet lid (or lid and seat), central portion 130 and arms 120, 140 are secured to the underside of the rear portion of the lid (i.e. the portion that, when the lid is attached to a toilet, lies proximate the cistern). Central portion 130 and arms 120, 140 are thus in direct contact with the basin. Arm 150 also extends underneath the lid/lid and seat (between the lid/lid and seat and the basin) and hooked portion 160 curves downwards into the basin. Paddle 170 lies proximate to the basin wall and underneath the lip of the basin from which (for most western style toilets) flushing water flows into the basin.

A length/thread of a flexible, resilient material, such as a cable (not shown) is attached at one end to the paddle 170. The cable extends along hooked portion 160 and arm 150 to the near centre of central portion 130 and is thread through a series of spaced-apart apertures (not shown) which extend perpendicularly from the rear face of hooked portion 160 and the underside of arm 150. The apertures restrict movement of the cable away from arm 150 and hooked portion 160, but allow movement along the length of hooked portion 160 and arm 150. This is to ensure proper operation of the closure mechanism, as will be described in further detail below. Alternatively, hooked portion 160 has a rear wall which forms an enclosed volume which restricts movement of the cable.

At the underside of central portion 130, near its centre, the cable forks into two sections which extend in opposite directions, such that one part extends along the underside of arm 120 and is connected to a component in housing 110 and the other part extends along the underside of arm 190 and is connected to a component in housing 190. The underside of central portion 130 and arms 120, 140 have grooves within which the cable lies. The cable may split in two, or alternatively the cable extending along arm 150 and hooked portion 160 may be connected to a second cable which extends along arms 120 and 140.

Figure 2:
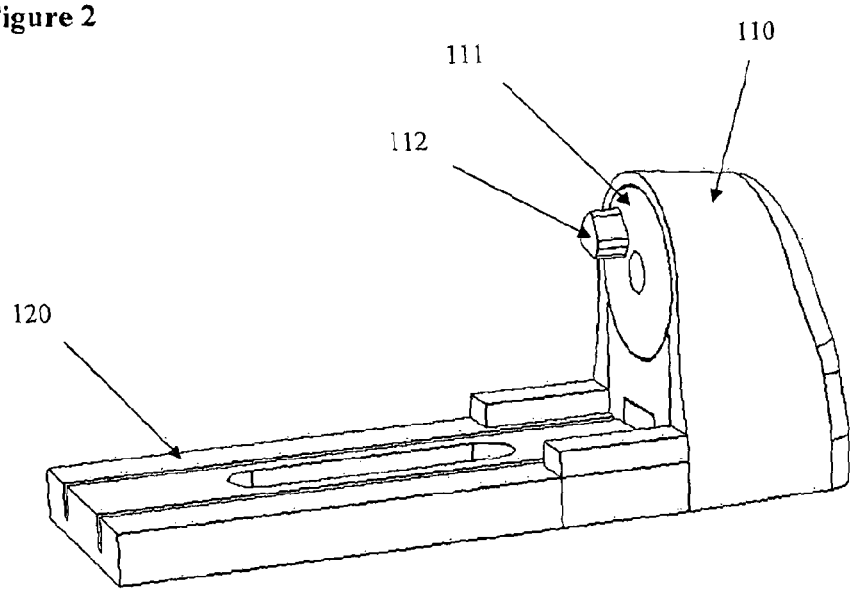
FIG. 2 is a perspective view of part of the device shown in FIG. 1.

FIG. 2 shows a perspective view of housing 110 and arm 120. Housing 110 is secured to arm 120 by a snap-fitting. Alternatively, arm 120 and housing 110 may be integral. Housing 110 comprises wheel 111 which is able to rotate within housing 110. Wheel 111 comprises lug 112 which extends from wheel 111 in a direction parallel to the axis of rotation of wheel 111. Lug 112 turns wheel 111 clockwise when a toilet lid is 'wedged' under lug 112 and is lifted from a closed position to an open position (as will be described in further detail below).

Figure 3:
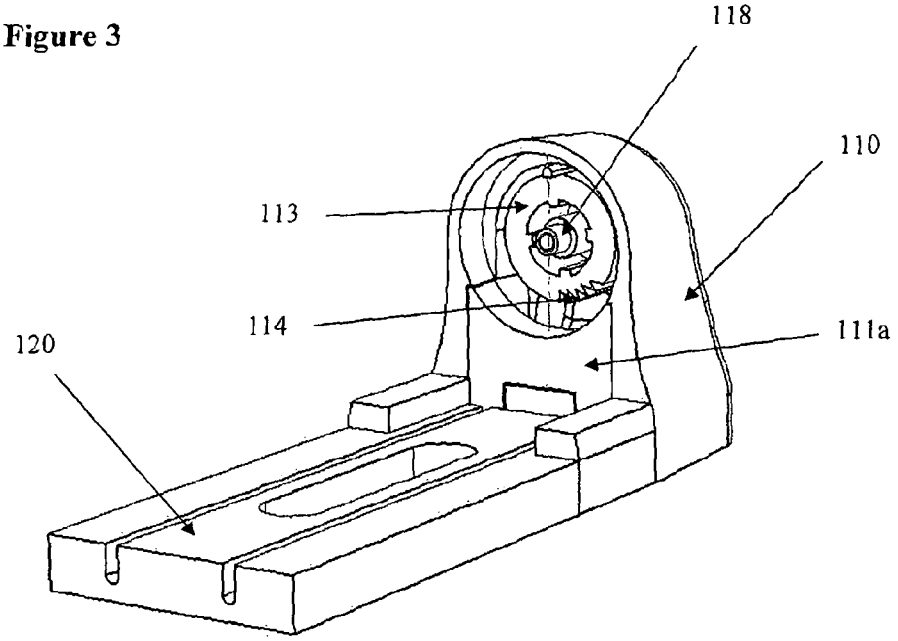
FIG. 3 is a perspective cut-away view of the part of the device shown in FIG. 2 showing components of the closure mechanism according to an embodiment.

The interior components of housing 110 can be seen from FIG. 3. Interior ring 113 is fixedly secured to wheel 111. A sawtooth portion 114 of the outer circumference of ring 113 comprises a series of teeth. Member 115 is mounted on a base 111*a* via pivot 116*a* and the distal end of member 115 from pivot 116*a* is biased upwards, in a clockwise direction about pivot 116*a*, by a tension spring (not shown, but which would occupy the space shown by reference 116 and pull downwards on member 115 to the right (as viewed from FIG. 4) of pivot 116*a*). Pawl 119 extends from member 115 and is received between two adjacent teeth, such that member 115 and ring 113 form a ratchet.

It will be appreciated that, as ring 113 moves anti-clockwise (as viewed in FIG. 4), the teeth on sawtooth portion 114 force pawl 115 downwards, acting against the bias of the compression spring. The ratchet formed by the pawl and teeth prevent ring 113 from rotating clockwise (as viewed from FIG. 4). The cable is connected at one end to the distal, free end of member 115. When the cable pulls on the distal end of member 115, against the bias of the compression spring, the pawl 119 is pulled out from between the teeth of sawtooth portion 114 and the ring 113 can move clockwise (as viewed from FIG. 4). A clock or power spring (not shown, but whose location is shown by reference 117 in FIG. 4) is affixed to, and surrounds ring 113, and resides in a recess between wheel 111 and ring 113. The power spring is arranged to bias ring 113 clockwise (as viewed from FIG. 4). Thus, when the ratchet is engaged it acts against the bias of the spring substantially surrounding ring 113.

Figure 4:
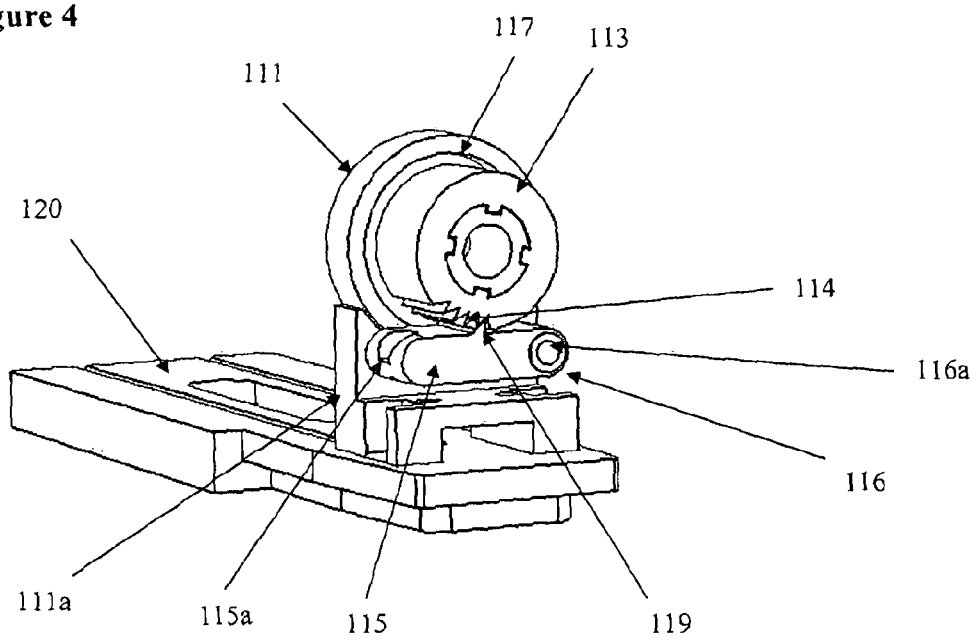
FIG. 4 is a rear perspective cut-away view of part of the device shown in FIG. 2 showing components of the closure mechanism according to an embodiment.

Operation of the closure mechanism will now be described with reference to FIG. 4. As mentioned above, a toilet lid fits between the upper surface of arms 120, 140 and the lug 112 on each of housings 110, 190. When the toilet lid/seat is raised from a horizontal position to a substantially vertical position, the engagement of the lid/seat under the lug 112 is such that the lug 112 also rotates as the lid/seat is raised. Since the lug 112 is fixedly attached to wheel 111 (which is fixedly attached to ring 113), rotation of the lug causes rotation of ring 113 against the bias of the power spring, such that the power spring is wound. Ring 113 rotates anticlockwise (when viewed from FIG. 4) and in the direction allowed by the ratchet. When rotation is complete and the lid/seat is substantially vertical (or resting against the cistern of the toilet or a rear wall), pawl 119 is allowed to remain between two teeth in sawtooth portion 114.

As mentioned above, an end of the cable is attached to paddle 170. When the toilet is flushed, water flows from under the lip of the toilet basin. The flushing water impacts on paddle 170. Paddle 170 collects water as flushed water flows downwards. The paddle 170 collects water until the weight of the collected water causes the paddle 170 to rotate about a horizontal axis and 'tip' the collected water out. The cable is attached to paddle 170 such that when the paddle rotates, the cable is pulled downwards. This, in turn, pulls on the ends of the cable connected to members in both housings 110 and 190.

Referring again to FIG. 4, and as mentioned above, the cable is fixed to end 115*a* of member 115. When the cable is pulled downwards, end 115*a* of member 115 is pulled downwards (and in an anticlockwise direction about pivot 116*a* when viewed from FIG. 4). The rotation of member 115 about pivot 116*a* disengages pawl 119 from between the teeth of sawtooth portion 114, thus allowing rotation of ring 113 in a clockwise direction under the bias of the power spring. Clockwise rotation of the ring 113 (connected to wheel 111) also causes rotation of the lug 112, which pushes the lid (or when the seat is also raised, the lid and seat) from its open or substantially vertical position to a closed or substantially horizontal position. The bias of the tension spring biases end 115*a* of member 115 towards ring 113 and therefore pulls upwards on the thread of material. This causes the counter rotation of the paddle 117 to return paddle 170 to its original starting position (i.e. in the position which allows it to collect water). The pawl 119 engages in a recess between two teeth of sawtooth portion 114 and the device is reset.

A damper (not shown) may be advantageously included in the design to soften the rotation of the lid as nears its horizontal position. The device 100 may also be advantageously 'de-activated' to prevent automatic lowering of the seat and/or lid. This may be achieved by use of a switch (not shown), which obstructs the movement of the thread of material.

All components of device 100 (apart from the thread of material) may be made from any suitable material, but preferably a durable and rigid plastic such as polyethylene which can withstand bleach and other corrosive substances which are often found in cleaning products.

Figure 5:
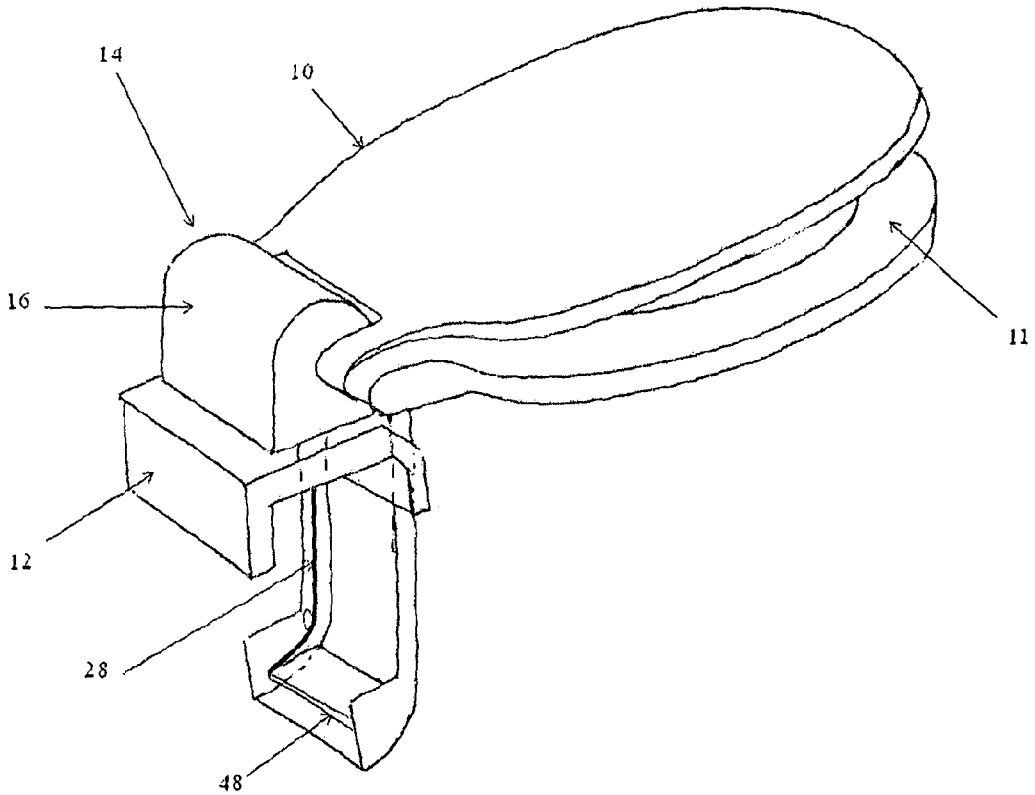
FIG. 5 is a schematic perspective view of a closure device attached to a toilet assembly according to an alternative embodiment of the present invention.

FIGS. 5 to 10 show an alternative embodiment of the present invention. FIG. 5 shows closure device 14 fitted to a typical toilet assembly comprising basin 12 (only a part of which is shown for clarity), lid 10 and seat 11.

In this embodiment, closure device 14 is secured, by any suitable means, to an upper surface of basin 12, and may be located between the hinge points of the lid 10 and seat 11, or to one side of the hinge points. Two or more devices 14 may be used in conjunction on a single toilet.

Closure device 14 comprises housing 16, which is shown cut-away in FIG. 5. As can be seen from FIG. 5, a portion of the housing 16 extends below seat 11 to within the basin 12 and supports receiving/activation member 48, which is pivotally secured to housing 16 such that receiving member 48 can rotate about a horizontal axis. A cable 28 extends from within the device 14 from above the upper surface of basin 12 and is attached to receiving member 48. As will be described in more detail below, water flowing onto receiving member 48 causes receiving member 48 to pull on cable 28 which activates a release mechanism to lower seat 11 and/or lid 10 from a substantially vertical position to a substantially horizontal position.

Figure 6:
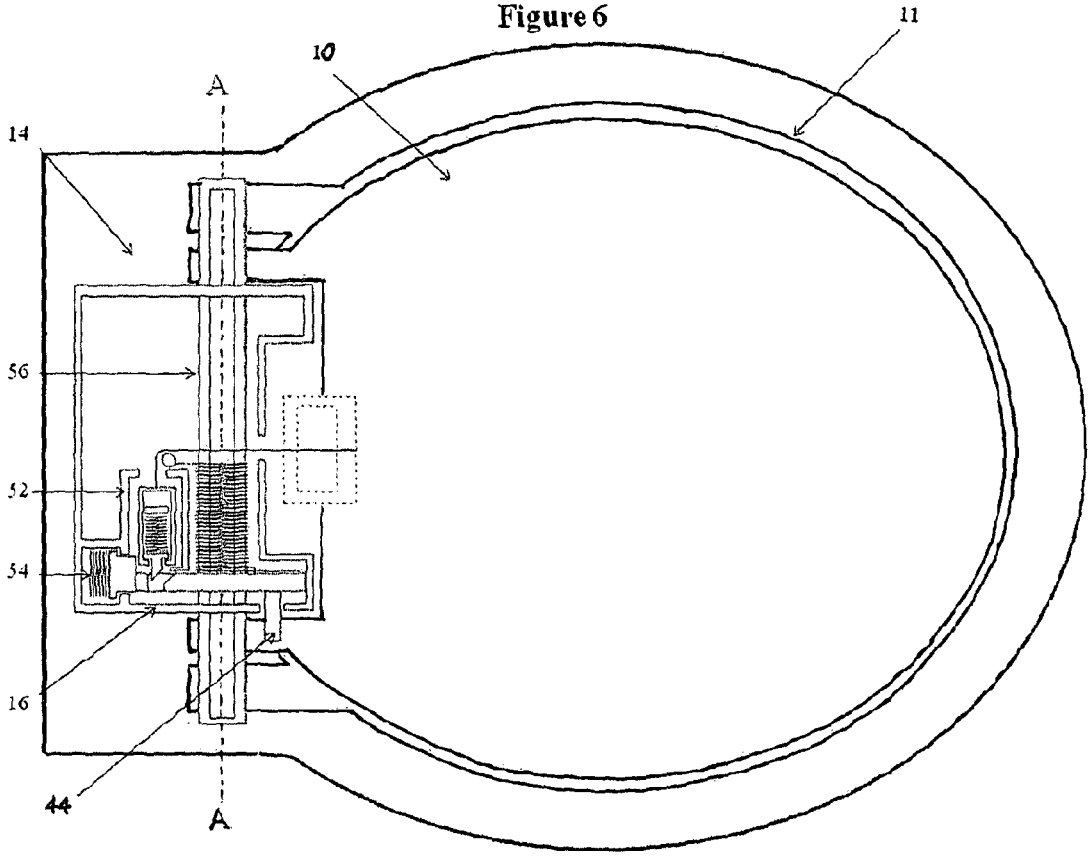
FIG. 6 is a schematic plan view of the device and assembly as shown in FIG. 5.
Figure 7:
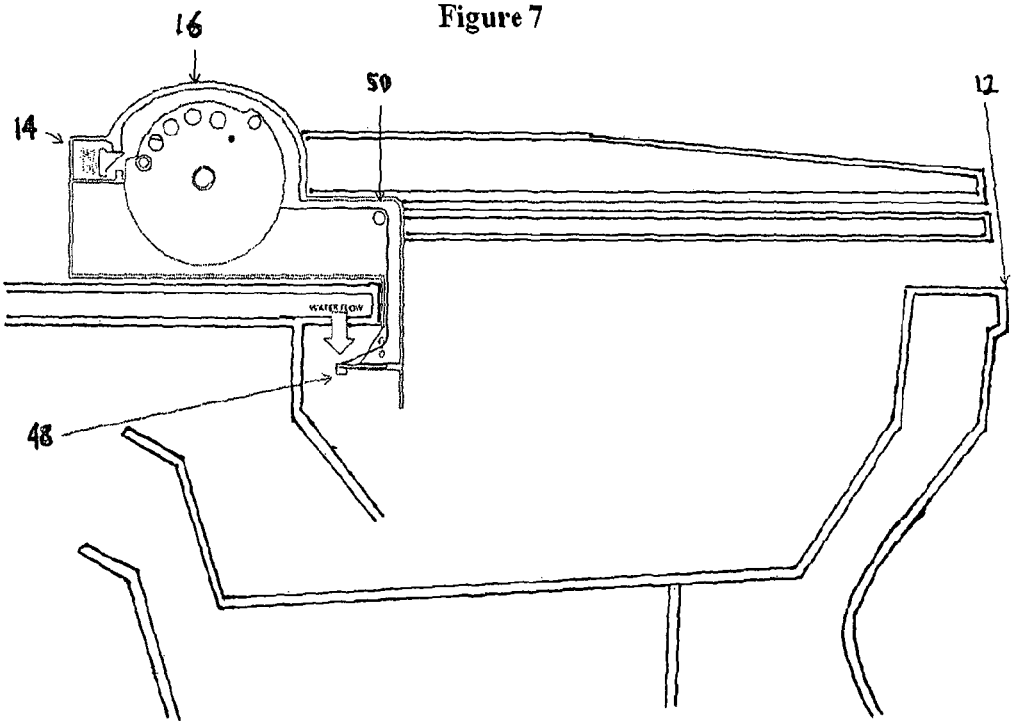
FIG. 7 is a schematic side view of the closure device shown in FIG. 5 and a toilet basin.

FIG. 6 shows a sectional plan view of the closure device 14 and toilet assembly of FIG. 5. As can be seen from FIG. 6, a horizontal axis-A' is defined as the hinge axis from which the lid 10 and seat 11 can pivot. FIG. 7 shows a sectional schematic side view of device 14 fitted to basin 12. Receiving member 48 is positioned under flange 50 of basin 12. In accordance with the design of the majority of modern western-style toilets, water flows from an outlet (not shown) and may be at least partially directed downwards by flange 50.

Figure 8:
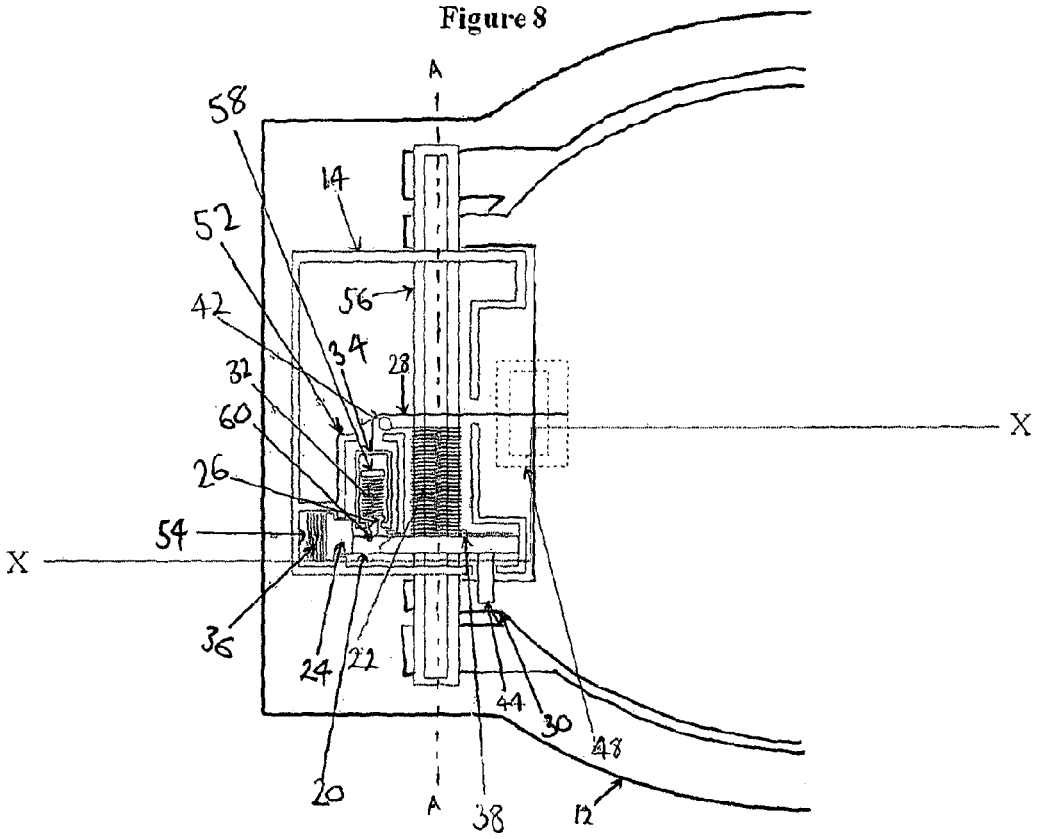
FIG. 8 is a schematic plan view of the closure device shown in FIG. 5.

The housing 16 may be any suitable shape which allows the device 14 to be fitted to existing toilet assemblies. As shown in FIG. 8 the housing 16 may be L-shaped. Housing 16 may be manufactured from any suitable material, such as ceramic or plastic. The housing 16 functions as a structure within which the components of the device operate and are protected. As can be seen from FIGS. 6 and 8, the device is positioned on basin 12 such that a strut 56 extends along horizontal axis A. Housing 16 comprises compartments 52 and 54.

The arrangement of the closure device 14 will be described with reference to FIGS. 4 and 5. Closure device 14 comprises a wheel 20 which is substantially circular and which may be made of any suitable durable, lightweight material, such as plastic. Wheel 20 lies in a plane perpendicular to axis A. As can be seen from FIG. 9, the circumferential contour of wheel 20 is non-uniform, such that a portion of wheel 20 has a reduced radius. Wheel 20 is rotatably/pivotally fixed to strut 56 such that it can rotate about horizontal axis A. Wheel 20 comprises a number of substantially circular apertures 40 located sequentially near its circumference around the portion having a reduced radius. Wheel 20 further comprises arm 44 which extends from a position near the circumference of wheel 20 where the radius is biggest, from one side of the wheel 20 in a direction parallel to axis A'A'. Arm 44 extends through an aperture in housing 16. Arm 44 is arranged to lie on top of a portion 30 of the toilet lid 10 near the hinge. A further arm 38 also extends from the same side of wheel 20 as arm 44 and is positioned at approximately the same angle as arm 44 at a sufficient distance away from the circumference of wheel 20 to allow an end of spring 22 to be fastened to it.

A helical torsion spring 22 encompasses part of the longest length of strut 56 and extends between an edge of housing 16 and wheel 20. The spring 22 may be formed of any suitable material, such as protected steel or polyurethane. One end of the spring 22 is secured to the strut 56 (and/or housing) and the opposite end is secured to arm 38 on the wheel 20. In some embodiments, the spring is such that it is arranged to lie below arm 38. The spring 22 is oriented such that rotations in the direction of B creates increases the potential energy stored in the spring 22.

With reference to FIG. 8, compartments 52 and 54 are located adjacent to wheel 20 on the opposite side of axis A to the lid 10 and seat 11. Compartment 52 has a substantially rectangular cross section in a horizontal plane and contains component 34. The length of component 34 is less than the length of compartment 52 such that component 34 is able to move within the compartment 52 in a direction parallel to axis A from a first position (as shown in FIG. 8) where one end of component 34 contacts the end of compartment 52 which is proximal to wheel 20, and second position, where one end of component 34 contacts the end of compartment 52 distal from wheel 20. Component 34 comprises a helical compression spring 32 whose longest axis lies in the direction of axis A and along the longest axis of compartment 52. The spring 32 may be formed from any suitable material such as protected steel. One end of spring 32 is secured to a stopping member 58, and the other end of spring 32, proximal to wheel 20, is secured to member 26 which acts as a latch. Member 26 comprises a cylindrical tapered portion 60. As can be seen from FIG. 8, cylindrical portion 60 is tapered such that its shortest edge faces a direction of rotation of wheel 20 denoted by B. The diameter of the cylindrical portion 60 is less than the diameter of the apertures 40 of wheel 20. Spring 32 is arranged to bias cylindrical portion 60 towards wheel 20, such that when component 34 is in its first position (as described above), cylindrical portion 60 is urged to extend through one of the apertures 40 of the wheel 20.

Figure 9:
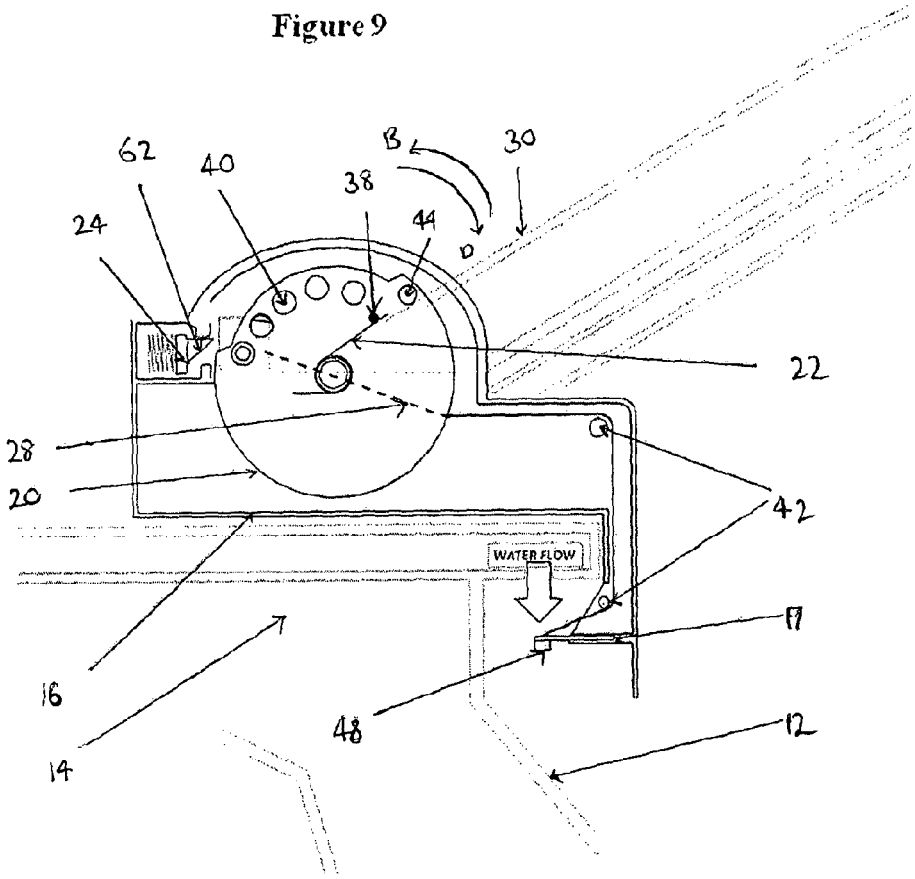
FIG. 9 is a schematic side view of the closure device shown in FIG. 5 and toilet basin.

As can be seen from FIGS. 7 and 9, one end of cable 28 is attached to the end of component 34. The other end of cable 28 is attached to receiving member 48. The cable 48 is prevented from interfering with components of the closure device 14 by members 42, within which the cable 28 is held and guided. As will be described in further detail below, movement of the cable caused by receiving member 48 undergoing a downward pivoting motion about a horizontal axis causes the component 34 to move from its first to its second position.

Compartment 54 has a substantially rectangular cross section in a horizontal plane and contains helical compression spring 36 and member 24. One end of spring 36 is secured to an end of compartment 54 distal to wheel 20 and the other end is secured to member 24. Spring 36 lies in a direction perpendicular to axis A and is arranged to bias member 24 towards wheel 20. Spring 36 may be formed from any suitable material such as protected steel. As can be seen from FIG. 9, member 24 comprises a tapered portion 62. The tapered edge of portion 62 faces downwards. With reference to FIG. 8, member 24 is prevented from contacting wheel 20 by the position of member 34 when member 34 is in its first position.

Operation of the closure device 14 will now be described, also with reference to FIGS. 8 and 9. An arming mechanism is activated upon lifting the lid 10 from a closed (i.e. horizontal position) to an open (i.e. upright) position. When the lid 10 is raised, movement of portion 30, upon which arm 44 rests, causes wheel 20 to rotate in direction B, and consequently twists spring 22 such that potential energy is stored in spring 22. As mentioned above, spring 32 of component 34 biases cylindrical portion 60 of member 26 in apertures 40 in wheel 20. As wheel 20 is rotated in the direction B, the taper of cylindrical portion 60 means that the forward force towards the wheel 20 caused by spring 32 will be opposed by the motion of wheel 20 in the direction B such that member 26 will be urged back until the position of one of the apertures 40 in a vertical plane corresponds to the position of cylindrical portion 60. At this point the cylindrical portion 60 can pass through one of the apertures 40.

When the seat 11 and/or lid 10 has been lifted to a substantially vertical position (i.e. such that it is able to be supported by a wall or water tank, for example) the arming mechanism is completed. When the seat 11 and/or lid 10 is in a raised position, cylindrical portion 60 of member 26 will extend through one of the apertures 40, which will be an aperture 40 closest to arm 44 of wheel 20. It will be appreciated that the position of cylindrical member 60 through an aperture 40 prevents rotation of the wheel 20 in a direction D. With reference to FIG. 9, it will be appreciated that upon lifting the seat 11 and or lid 10, wheel 20 will have been rotated such that the portion of wheel 20 having a reduced radius will be positioned substantially below axis A. As mentioned above, member 24 will be prevented from contacting wheel 20 by member 34.

A release mechanism of closure device 14 is activated upon the toilet being flushed. The default position of receiving member 48 is such that the downward force caused by flushing water will cause receiving member 48 to pivot about an axis defined by a hinge which secures it to part 17 of housing 16. Receiving member 48 may be of any suitable shape or construction to allow it to pivot from a position which it assumes when the toilet is not being flushed, to a pivoted position whereby a sufficient amount or force of water has caused it to pivot. Receiving member 48 is preferably formed from a durable plastic, and may be bucket or scoop shaped, such that it is configured to collect a volume of water, the weight of which causes it to pivot. The volume of water required to effect a pivoting motion may be determined or adjusted by the hinge (not shown) which secures receiving member 48 to part 17 of housing 16. In an alternative embodiment, the receiving member 48 may be in the form of a water wheel, and configured in which a way that sufficient rotation causes the cable 28 to be pulled by a predetermined amount. Receiving member 48 is biased, by any suitable means, such as a leaf spring, to return to a default position. Movement of receiving member 48 back to it default position pushes cable 28 so that component 34 is moved back to its first position.

As can be seen from FIG. 9, downward pivoting motion of receiving member 48 causes cable 28 to be pulled. This action causes component 34 to move from its first position (wherein cylindrical portion 60 extends through an aperture 40), to a second position (where cylindrical portion does not extend through an aperture 40). When cylindrical member 60 is removed from an aperture 40, the wheel 20 is able to rotate in direction D, urged to move by the spring 22. When component 34 is in a second position, it no longer prevents member 24 from contacting wheel 20. Upon movement of component 34 to a second position, spring 36 forces member 24 forward towards wheel 20, such that the end of member 36 contacts the wheel 20. As wheel 20 is caused to rotate in direction D by the stored potential energy of spring 22, the lid 10 also rotates in direction D about axis A from a substantially vertical position to a substantially horizontal position. In some embodiments, a damping mechanism may be used in conjunction with the release mechanism to regulate the speed at which the lid is forced downwards.

When member 24 contacts wheel 20, member 26 is prevented from contacting wheel 20 and therefore cylindrical portion 60 cannot pass through apertures 40 which would prevent wheel 20 from rotating in direction D. Member 24 allows wheel 20, and therefore lid 10, to rotate freely in a direction D. With reference to FIG. 9, it can be seen that member 24 contacts the portion of wheel 20 which has a reduced radius. When rotation in the direction D is complete and the seat 11 and/or lid 10 is closed, member 24 will contact wheel 20 at a portion having a greater radius. When the wheel 20 is near, or is at, completion of its rotation, the variation in the circumferential contour of wheel 20 and the tapered edge of member 24 will cause member 24 to be pushed away from axis A. Movement of member 24 away from wheel 20 allows spring 32 to urge member 24 towards wheel 20, so as to reset the closure device 14.

The device 14 may also be advantageously 'de-activated' after installation on a toilet assembly, thereby preventing automatic lowering of the seat and/or lid without having to remove the device from the toilet. This may be achieved by allowing easy access to the inner components of the device (by having an opening of the housing 16) so that cable 28 can be disengaged by component 34, for example.

The invention claimed is:

1. A toilet seat and/or lid assembly comprising a toilet seat and/or lid and a device for automatically lowering a toilet seat and/or lid, the device comprising a closure mechanism and an activation member, the activation member depending from the toilet seat and/or lid so as to be positioned, in use, in a toilet basin below an upper surface thereof, the activation member being arrange to be moved by flow of water from a cistern into the toilet basin from flushing the toilet, wherein movement of the activation member activates the closure mechanism to close the toilet seat and/or lid.

2. The assembly of claim 1, wherein the activation member comprises a paddle, scoop, bucket or water wheel.

3. The assembly of claim 1, further comprising a spring arranged to bias the seat closed.

4. The assembly of claim 3, wherein the spring is a power or clock spring.

5. The assembly of claim 3, wherein the assembly further comprises a rotatable member and wherein the spring is connected to the rotatable member.

6. The assembly of claim 5, wherein the rotatable member is arranged to rotate when the toilet seat and/or lid is lifted from a substantially horizontal position to a substantially vertical position.

7. The assembly of claim 1, wherein the closure mechanism comprises a ratchet.

8. The assembly of claim 5, wherein the rotatable member comprises a ratchet rack, and wherein activation of the closure mechanism releases a pawl from the ratchet rack.

9. The assembly of claim 8, wherein the pawl is connected to the activation member by flexible, inelastic means, such as a cable.

10. The assembly of claim 1, wherein the closure mechanism is arranged to be positioned, in use, above the upper surface of a toilet basin.

11. A toilet seat and/or lid assembly comprising a device for automatically lowering a toilet seat and/or lid, comprising:

a rotatable member arranged to rotate in a first direction when the seat and/or lid is raised, a ratchet to prevent rotation of the rotatable member in a second direction, and an activation member connected to the ratchet, wherein the activation member is positioned, in use, in a toilet basin and is arranged to move when the toilet is flushed, and wherein movement of the activation member is arranged to release the ratchet;

wherein the rotatable member and ratchet are arranged to be positioned, in use, above an upper surface of a toilet basin.

12. The assembly of claim 11, wherein the activation member is arranged to pivot about a horizontal axis when the toilet is flushed.

13. The assembly of claim 11, wherein the activation member is connected to the ratchet by flexible, inelastic means, such as a cable.

14. The assembly of claim 11, wherein the activation member comprises a paddle or wheel.

15. The assembly of claim 11, wherein the rotatable member is generally circular, and wherein a portion of a circumferential edge of the rotatable member comprises teeth.

16. The assembly of claim 11, wherein the rotatable member is arranged to pivot about a horizontal axis defined by a hinge of the seat and/or lid.

17. The assembly of claim 11, wherein the rotatable member is connected to a spring, and wherein the spring is wound by rotating the rotatable member in a first direction.

18. The assembly of claim 17 wherein the spring is arranged to be wound when the toilet seat and/or lid is raised from a substantially horizontal position to a substantially vertical position.

19. A method of automatically lowering a toilet lid, comprising the steps of:

rotating a rotatable member in a first direction when the toilet seat and/or lid is lifted, wherein rotating the rotatable member winds a power spring;

securing the rotatable member when the seat and/or lid is in a raised position, releasing the rotatable member to allow it to rotate in a second direction, wherein rotation of the rotatable member in a second direction is caused by the power spring and rotation of the rotatable member lowers the seat and/or lid, wherein the rotatable member is released when an activation member is moved by flow of water from the cistern into the toilet basin from flushing the toilet.

20. The method of claim 19, wherein the step of securing comprises preventing rotation of the rotatable member by a ratchet.

21. The method of claim 19 wherein the step of releasing comprises releasing the ratchet against a bias of a compression spring.

22. The method of any of claim 21 further comprising resetting the rotatable member after the rotatable member has been released, by engaging the ratchet.

23. A toilet including an assembly according to claim 1.

* * * * *